US006840376B2

(12) United States Patent
Chen

(10) Patent No.: US 6,840,376 B2
(45) Date of Patent: Jan. 11, 2005

(54) MULTIPLE-LAYER TOOL BOX

(76) Inventor: Chin-Hui Chen, 11F-2, No. 43, Chai-I Street, Taichung City (TW)

( * ) Notice: Subject to any disclaimer, the term of this patent is extended or adjusted under 35 U.S.C. 154(b) by 71 days.

(21) Appl. No.: 10/402,763

(22) Filed: Mar. 28, 2003

(65) Prior Publication Data

US 2004/0188296 A1 Sep. 30, 2004

(51) Int. Cl.[7] ..... B65D 85/28
(52) U.S. Cl. ..... 206/373; 206/349; 312/902
(58) Field of Search ..... 206/372–379, 206/349, 485; 312/244, 902; 220/4.29, 212, 523, 4.39

(56) References Cited

U.S. PATENT DOCUMENTS 4,659,154 A * 4/1987 Jenkins ..... 312/277
4,662,515 A * 5/1987 Newby, Sr. ..... 206/349
5,244,265 A * 9/1993 Chiang ..... 312/107
5,758,933 A * 6/1998 Clendening ..... 312/205
6,264,030 B1 * 7/2001 Tsou ..... 206/372
6,294,759 B1 * 9/2001 Dunn, Jr. ..... 219/231
6,578,937 B1 * 6/2003 Thoman ..... 312/107
6,736,265 B2 * 5/2004 Kipper et al. ..... 206/373

* cited by examiner

*Primary Examiner*—Jila M. Mohandesi
(74) *Attorney, Agent, or Firm*—Charles E. Baxley

(57) ABSTRACT

A tool box includes a left cover and a right cover which are pivotably connected on the left sidewall and the right sidewall respectively. The left cover, the right cover, the left sidewall and the right sidewall each have grooves defined in an inside thereof so that a first layer and a second layer connected by two rods are movably received between the left cover, the right cover, the left sidewall and the right sidewall by engaging protrusions on the first layer and the second layer in the grooves. The grooves each have two recesses defined in an inside thereof so that the protrusions can be shifted into the recesses to set the first layer and the second layer in position. Casters are connected to an under side of the tool box and allow the tool box to be moved in a convenient way.

6 Claims, 7 Drawing Sheets

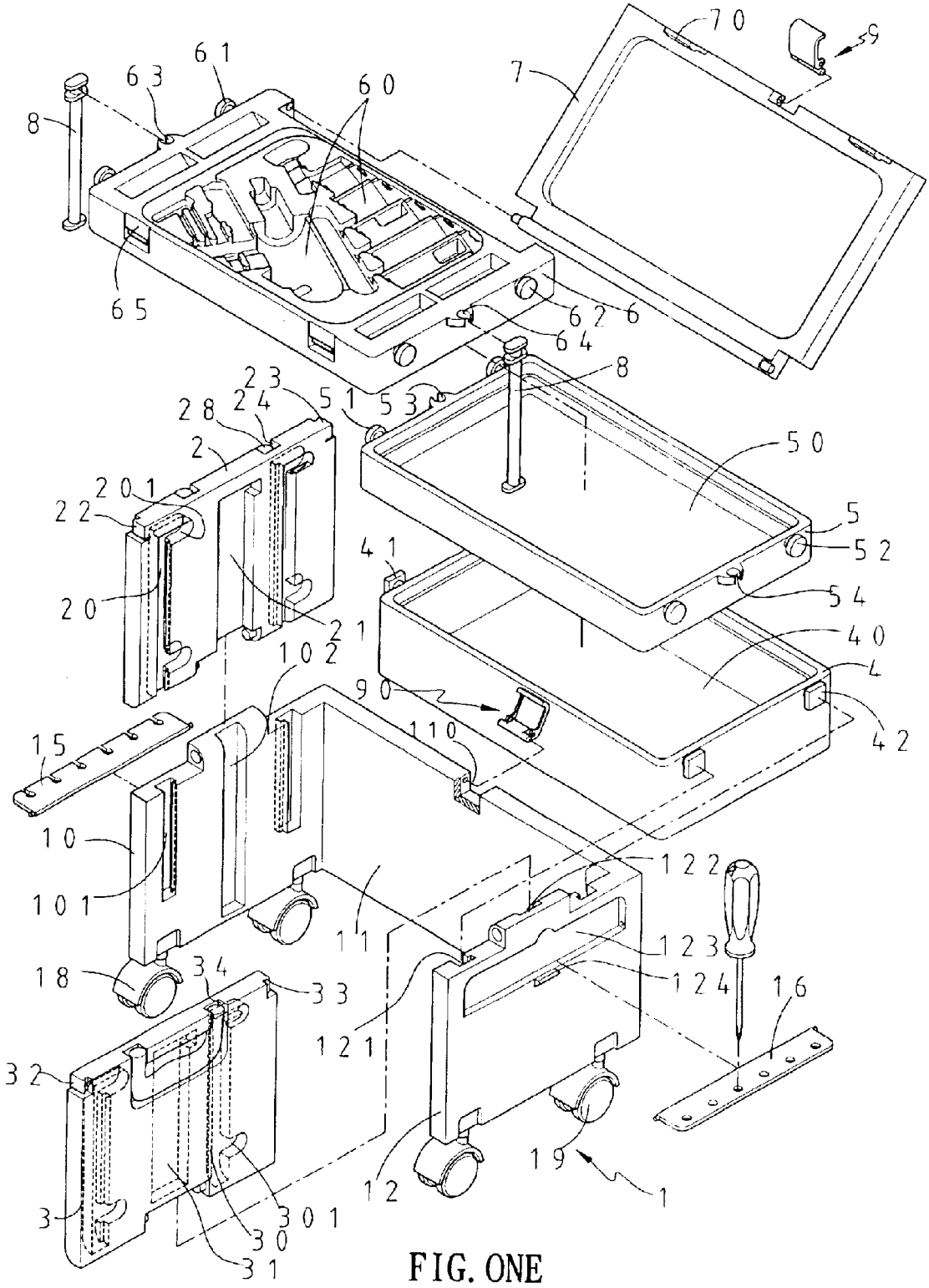
FIG. ONE

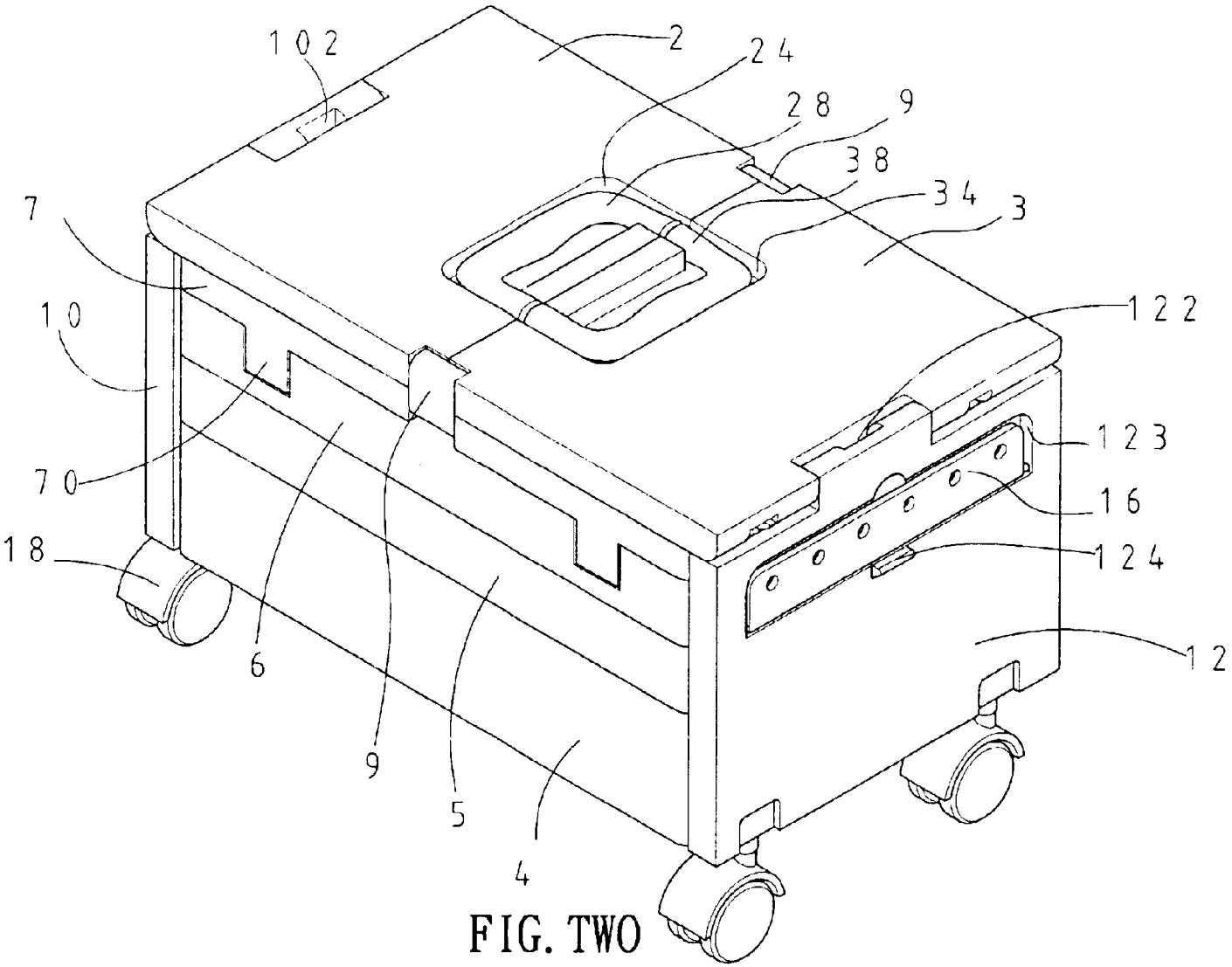
FIG. TWO

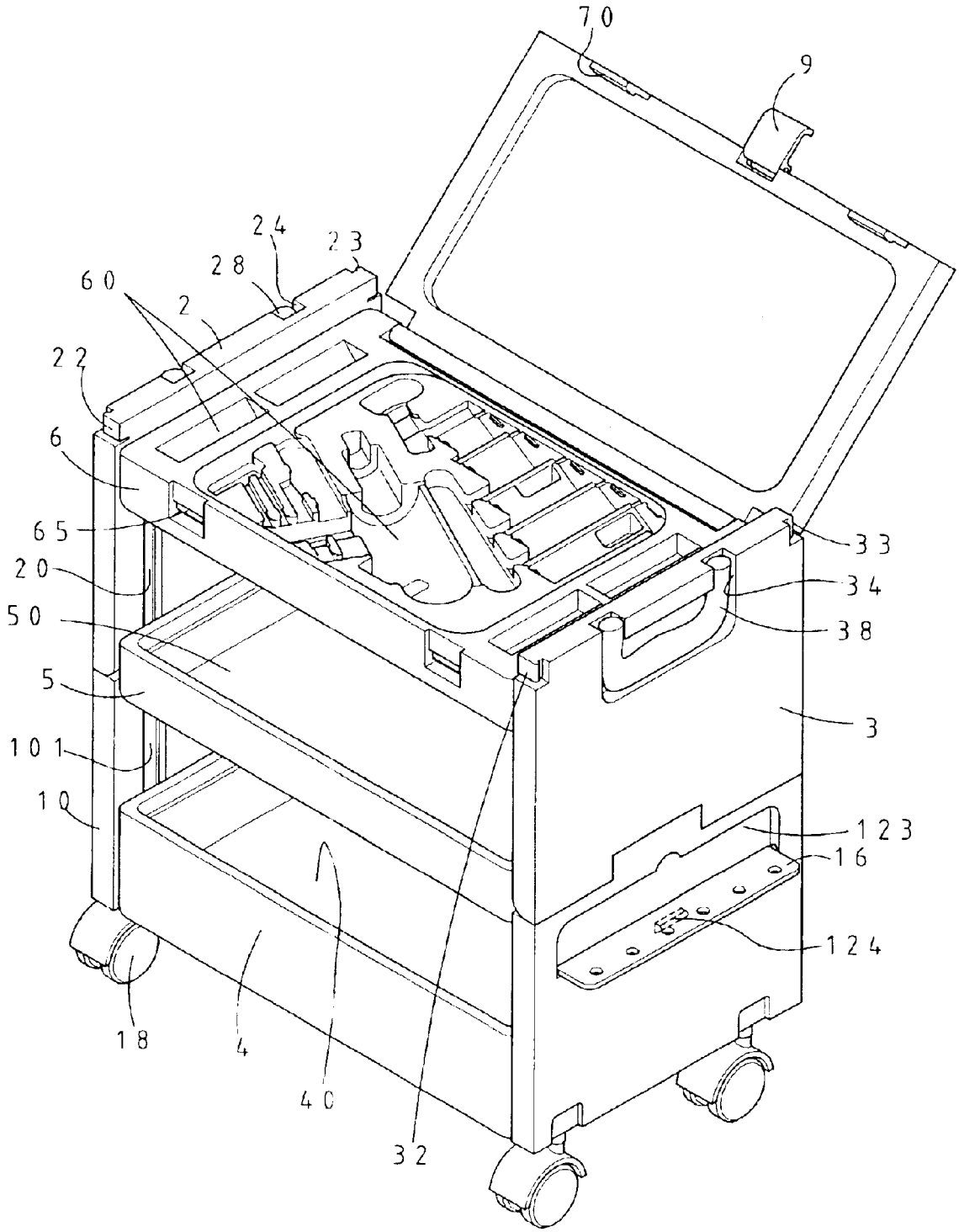
FIG. THREE

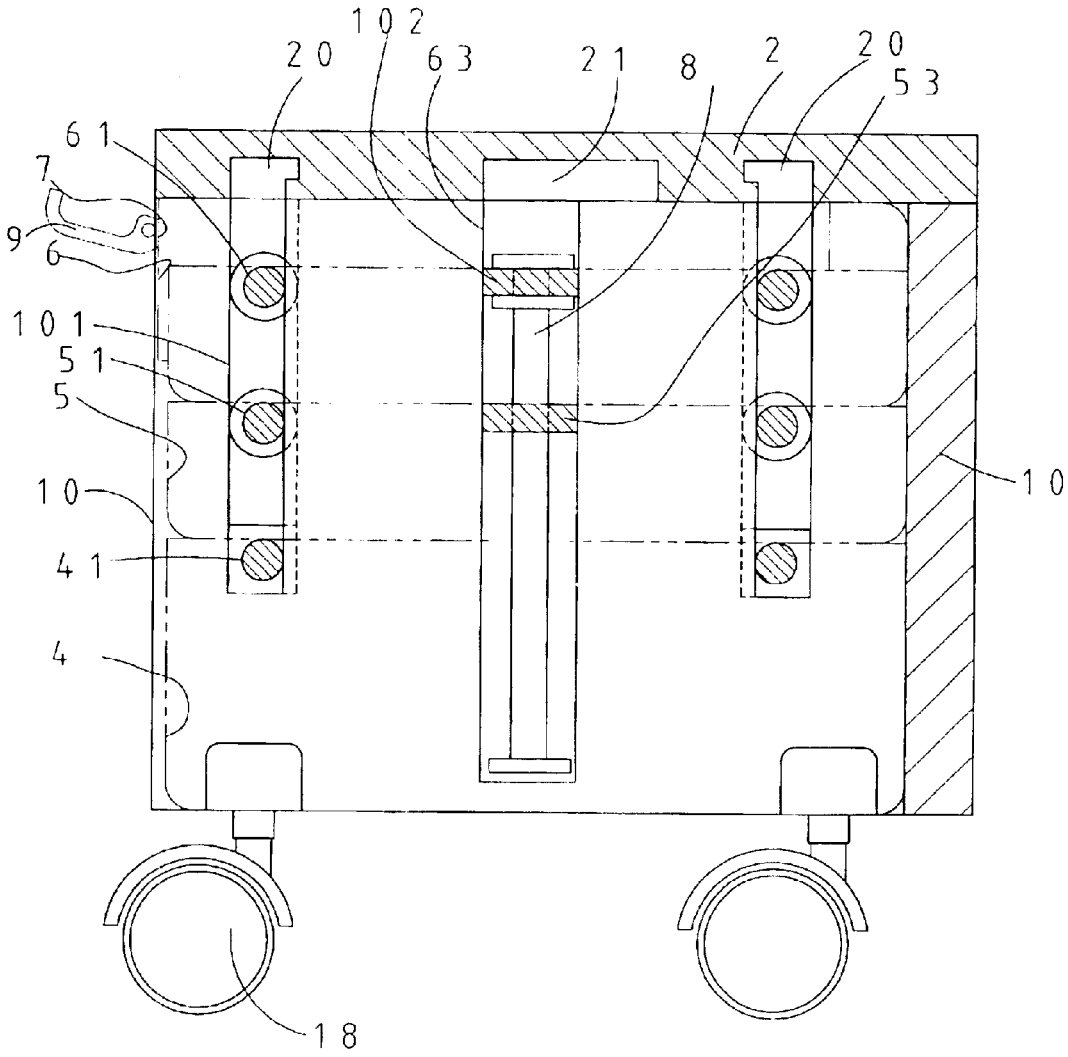
FIG. FOUR

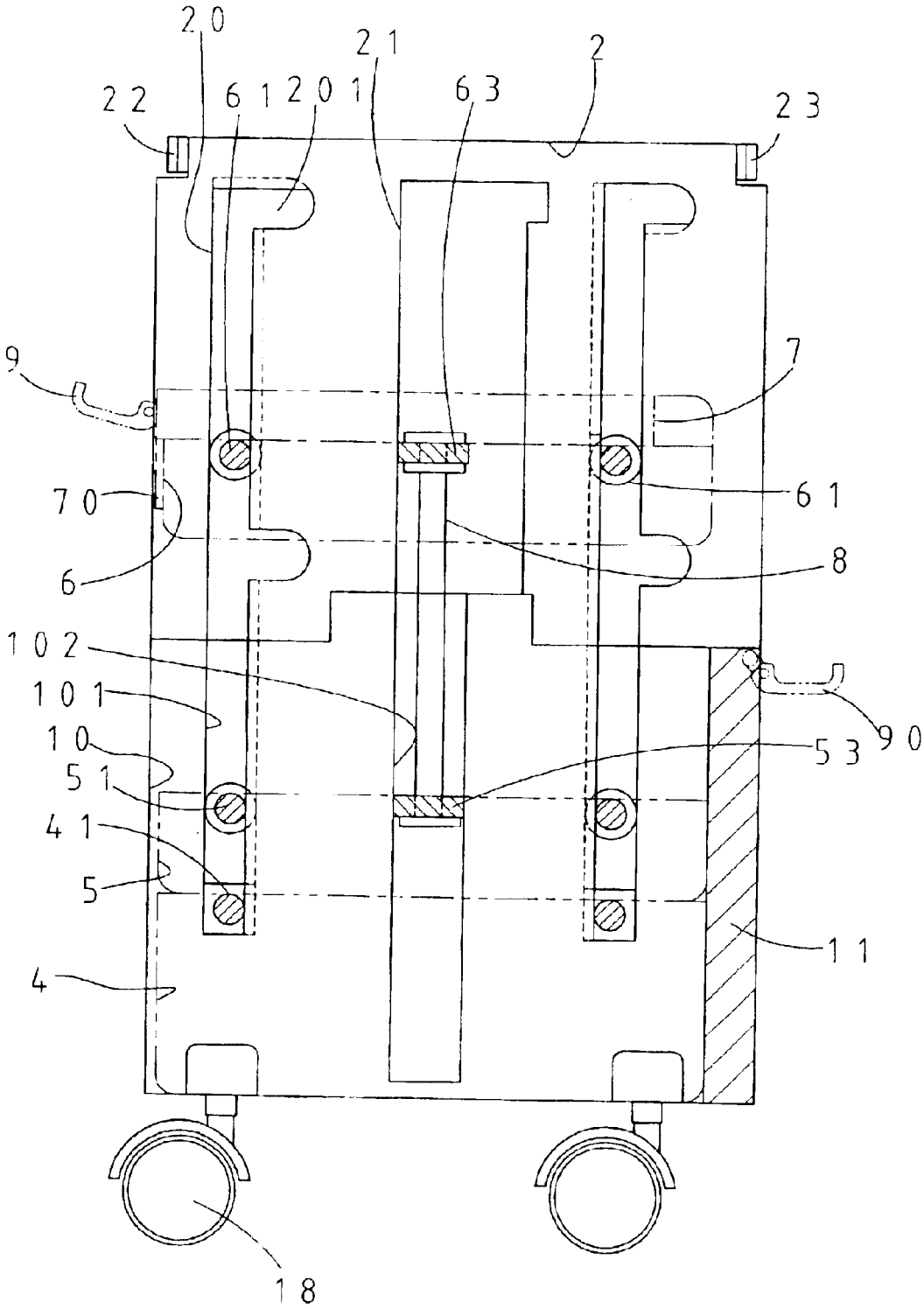
FIG. FIVE

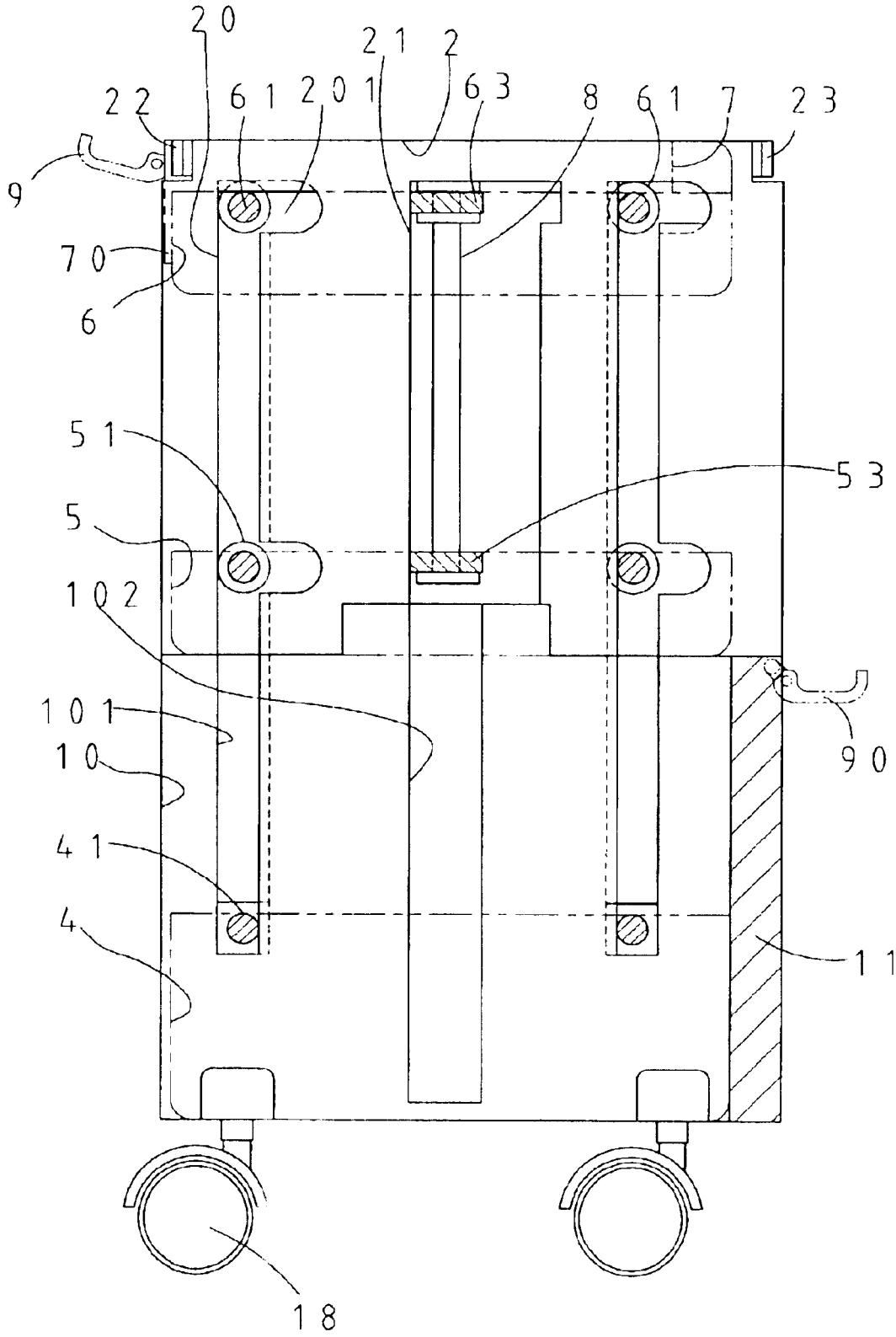
FIG. SIX

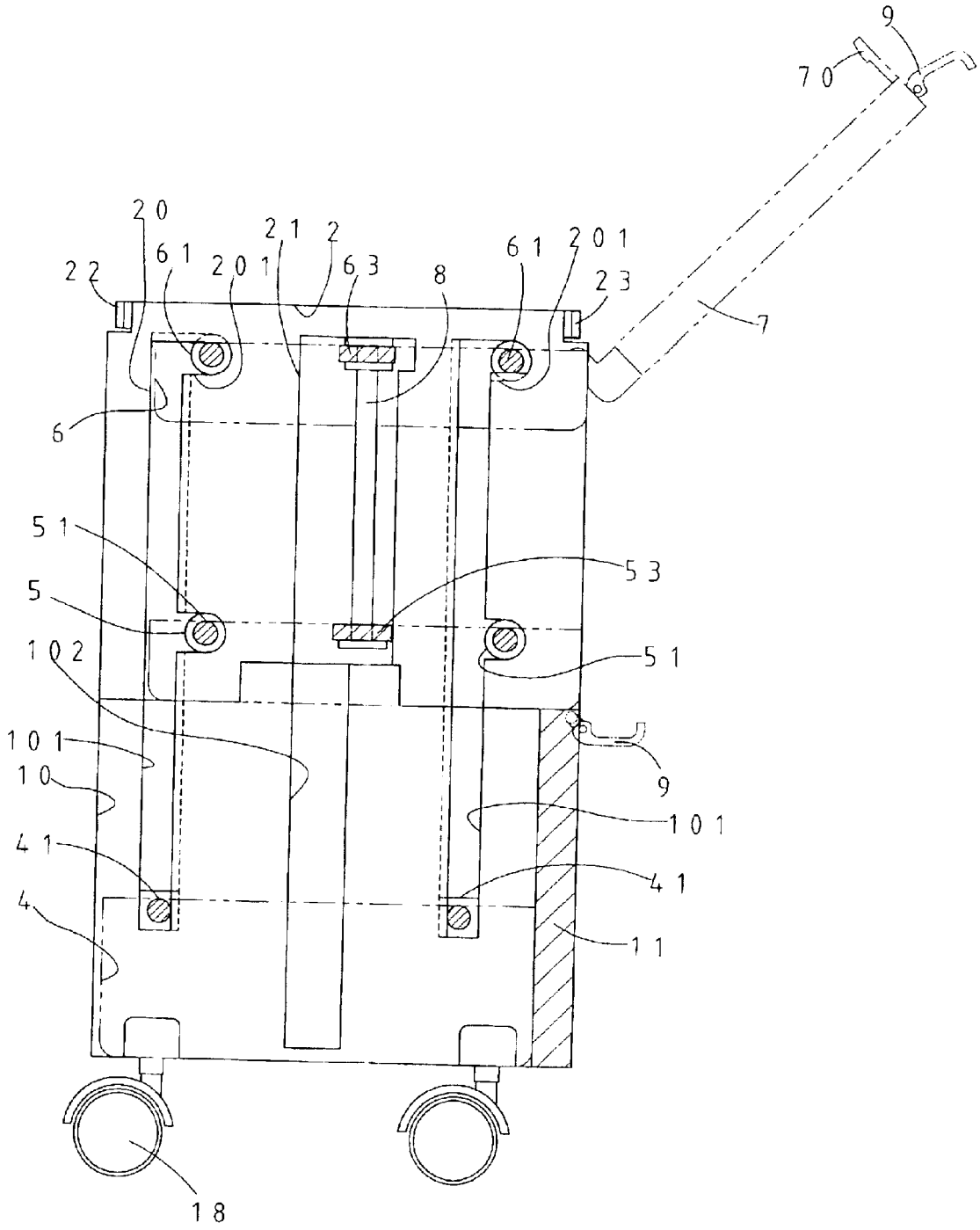
FIG. SEVEN

MULTIPLE-LAYER TOOL BOX

FIELD OF THE INVENTION

The present invention relates to a tool box, and more particularly, to a multiple-layer tool box and four casters are connected to a bottom of the tool box.

BACKGROUND OF THE INVENTION

A conventional tool box generally includes a base and a cover which is pivotably connected to the base and the base includes several tool receiving partitions for receiving tools or bits therein. The space in the base is limited so that the user cannot put extra tools or accessories during work in the box. Besides, the tool box and the tools are heavy in weight and the users have to lift and carry the tool box by hand.

The present invention intends to provide a tool box that is equipped with casters so that it can be easily moved with the users and layers can be raised vertically and set in position.

SUMMARY OF THE INVENTION

In accordance with one aspect of the present invention, there is provided a tool box which comprises a left sidewall, a right sidewall and a back wall connected between the left sidewall and the right sidewall. Each of the left sidewall and the right sidewall includes two first guide grooves and one second groove defined in an inside thereof A left cover and a right cover are respectively and pivotably connected to two respective tops of the left sidewall and the right sidewall. Each of the left cover and the right cover has two third grooves and one fourth groove defined in an inside thereof. The first grooves is in communication with the third grooves and the second grooves are in communication with the fourth grooves when the left cover and the right cover are pivoted upright in align with the left sidewall and the right sidewall. Each of the third grooves has two recesses defined in an inside thereof.

A base has two pairs of first protrusions extending from an outside of a peripheral wall of the base and the first protrusions are received in the first grooves. A first layer has two pairs of second protrusions extending from an outside of a peripheral wall of the first layer, and the second protrusions are movably received in the first grooves.

A second layer has two pairs of third protrusions extending from an outside of a periphery wall of the second layer, and the third protrusions are movably received in the first grooves. The second layer is located above the first layer. Two rods are respectively and movably received in the two second grooves and two stops are located at two ends of each of the two rods. Each of the first layer and the second layer has two engaging members which embrace the two rods.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show the tool box of the present invention;

FIG. 2 is a perspective view to show the tool box of the present invention wherein the two covers are not opened yet;

FIG. 3 is a perspective view to show the two covers are positioned at upright position and the top board are opened;

FIG. 4 is a cross sectional view to show the tool box of the present invention in the state as shown in FIG. 1;

FIG. 5 is a cross sectional view to show the tool box of the present invention wherein the second layer is raised;

FIG. 6 is a cross sectional view to show the tool box of the present invention wherein the first layer is raised, and FIG. 7 is a cross sectional view to show the tool box of the present invention wherein the first layer and the second layer are shifted and the protrusions are engaged with the recesses.

DETAILED DESCRIPTION OF THE PREFERRED EMBODIMENT

Referring to FIGS. 1 to 4, the tool box of the present invention comprises a basic part 1 which is composed of a left sidewall 10, a right sidewall 12 and a back wall 11 which is connected between the left sidewall 10 and the right sidewall 12. Each of the left sidewall 10 and the right sidewall 12 includes two first guide grooves 101/121 and one second groove 102/122 defined in an inside thereof. Two casters 18/19 are connected to an underside of each of the left sidewall 10 and the right sidewall 12. A receiving area 123 is defined in an outside of each of the left sidewall 10 and the right sidewall 12 such that a display plate 15/16 is pivotably received in the receiving area 123 and can be secured by the locking piece 124. Each display plate 15/16 includes holes so that tools such as screwdrivers can be inserted in the holes.

A left cover 2 and a right cover 3 are respectively and pivotably connected to two respective tops of the left sidewall 10 and the right sidewall 12. Each of the left cover 2 and the right cover 3 has two third grooves 20/30 and one fourth groove 21/31 defined in an inside thereof. The first grooves 101/121 are in communication with the third grooves 20/30 and the second grooves 102, 122 are in communication with the fourth grooves 21, 31 when the left cover 2 and the right cover 3 are pivoted upright in align with the left sidewall 10 and the right sidewall 12 as shown in FIG. 3. Each of the third grooves 20, 30 has two recesses 201 defined in an inside thereof. Each of the left cover 2 and the right cover 3 has two engaging parts 22, 23 and 32, 33 on two ends of a distal end thereof. Each of the left cover 2 and the right cover 3 has a concave 24/34 defined in an outside thereof and a handle 28/38 is received in the concave 24/34 and in flush with the surface of the outside of the left cover 2 and the right cover 3.

A base 4 has two pairs of first protrusions 41, 42 extending from an outside of a peripheral wall of the base 4 and the first protrusions 41, 42 are received in the first grooves 101, 121. Tools and/or accessories can be received in the space 40 in the base 4. A first layer 5 has two pairs of second protrusions 51, 52 extending from an outside of a peripheral wall of the first layer 5 and the second protrusions 51, 52 are movably received in the first grooves 101, 121. A second layer 6 has two pairs of third protrusions 61, 62 extending from an outside of a periphery wall of the second layer 6 and the third protrusions 51, 52 are movably received in the first grooves 101, 121. The first layer 5 is located above the base 4 and the second layer 6 located above the first layer 5. Tools and accessories can also be received in the two respective spaces 50 and 60 of the first layer 5 and the second layer 6.

Two rods 8 are respectively and movably received in the two second grooves 102, 122 and two stops are located at two ends of each of the two rods 8. Each of the first layer 5 and the second layer 6 has two engaging members 53, 54, and 63, 64 which embrace the two rods 8. The engaging members 53, 54 may movably embrace or fixed to the rods 8.

A top board 7 is pivotably connected to a side of the second layer 6 and a first locking member 9 is connected to a side of the top board 7 so that the top board 7 may cover onto the second layer 6 and two snap members 70 on the top board 7 can be engaged with two cooperated members 65 on the second layer 6 to secure the connection of the top board 7 and the second layer 6. A second locking member 90 is connected to a top edge of the back wall 11 so that the first locking member 9 and the second locking member 90 are respectively engaged with the engaging parts 22, 23 and 32, 33 when the left cover 2 and the right cover 3 are covered on the top board 7 in a horizontal position as shown in FIG. 2.

Referring to FIG. 5, when lifting the second layer 6, the third protrusions 61, 62 move in the first and third grooves 101, 121 and 20, 30 so that the gap between the first layer 5 and the second layer 6 is increased. When continuously lifting the second layer 6, the rods 8 are lifted by the engaging members 63, 64 as shown in FIG. 6, the first layer 5 is raised by lower stops of the rods 8 which pull the engaging members 53, 54 of the first layer 5. As shown in FIG. 7, the first layer 5 and the second layer 6 are then pushed horizontally to allow the third protrusions 51, 52 and the third protrusions 61, 62 to be engaged with the recesses 201 so that the two layers 5, 6 will not collapse downward. In the meanwhile, the first layer 5 is located at the folding plane between the left cover 2 and left sidewall 10, and the folding plane between the right cover 3and right sidewall 12 such that the two covers 2 and 3 will not suddenly pivoted downward.

The layers 5 and 6 can be easily folded to make the tool box as a compact tool box and the casters 18, 19 allow the user to move the tool box easily. The two layers 5, 6 are conveniently positioned so that the user may see the tools and/or accessories in the base 4, the first layer 5 and the second layer 6 conveniently.

While we have shown and described the embodiment in accordance with the present invention, it should be clear to those skilled in the art that further embodiments may be made without departing from the scope of the present invention.

What is claimed is:

1. A tool box 1 comprising:

a left sidewall, a right sidewall and a back wall which is connected between the left sidewall and the right sidewall, each of the left sidewall and the right sidewall including two first guide grooves and one second groove defined in an inside thereof;

a left cover and a right cover respectively and pivotably connected to two respective tops of the left sidewall and the right sidewall, each of the left cover and the right cover having two third grooves and one fourth groove defined in an inside thereof, the first grooves being in communication with the third grooves and the second grooves being in communication with the fourth grooves when the left cover and the right cover are pivoted upright in align with the left sidewall and the right sidewall, each of the third grooves having two recesses defined in an inside thereof;

a base having two pairs of first protrusions extending from an outside of a peripheral wall of the base, the first protrusions received in the first grooves, a first layer having two pairs of second protrusions extending from an outside of a peripheral wall of the first layer, the second protrusions movably received in the first grooves, and a second layer having two pairs of third protrusions extending from an outside of a periphery wall of the second layer, the third protrusions movably received in the first grooves, the second layer located above the first layer, two rods respectively and movably received in the two second grooves and two stops located at two ends of each of the two rods, each of the first layer and the second layer having two engaging members which embrace the two rods.

2. The tool box as claimed in claim 1, wherein each of the left sidewall and the right sidewall includes a display plate pivotably connected to an outside thereof and each display plate includes holes.

3. The tool box as claimed in claim 1 further comprising a top board which is pivotably connected to a side of the second layer and a first locking member connected to a side of the top board, a second locking member connected to a top edge of the back wall, each of the left cover and the right cover having two engaging parts on two ends of a distal end thereof, the first locking member and the second locking member respectively engaged with the engaging parts when the left cover and the right cover are covered on the top board in a horizontal position.

4. The tool box as claimed in claim 1 wherein each of the left cover and the right cover has a handle connected to an outside thereof.

5. The tool box as claimed in claim 4 wherein each of the left cover and the right cover has a concave and the handle is received in the concave.

6. The tool box as claimed in claim 1 wherein each of the left sidewall and the right sidewall has two casters connected thereto.

* * * * *